US006114802A

United States Patent [19]

Amrine et al.

[11] Patent Number: 6,114,802

[45] Date of Patent: Sep. 5, 2000

[54] FIELD EMISSION DEVICE HAVING STAMPED SUBSTRATE AND METHOD

[75] Inventors: Craig Amrine, Tempe; Kenneth Dean; Curtis D. Moyer, both of Phoenix, all of Ariz.

[73] Assignee: Motorola, Inc., Schaumburg, Ill.

[21] Appl. No.: 08/808,382

[22] Filed: Feb. 28, 1997

[51] Int. Cl.[7] ..... H01J 19/24; H01J 29/04

[52] U.S. Cl. ..... 313/309; 313/497; 313/336; 313/351; 313/306

[58] Field of Search ..... 313/495, 497, 313/309, 336, 351, 306, 308

[56] References Cited

U.S. PATENT DOCUMENTS 5,424,605 6/1995 Lovoi ..... 313/495 X
5,587,623 12/1996 Jones ..... 313/495 X
5,589,731 12/1996 Fahlen et al. ..... 313/495

*Primary Examiner*—Ashok Patel
*Attorney, Agent, or Firm*—Jasper W. Dockrey; S. Kevin Pickens

[57] ABSTRACT

A field emission device (400) includes a plastically-deformable, ceramic, stamped substrate (200) made from a plastically deformable ceramic, which in the preferred embodiment includes a calendered tape. The plastically-deformable, ceramic, stamped substrate (200) includes first and second opposed surfaces (202, 204) and defines apertures (206) in which are formed extraction electrodes (410). The field emission device (400) further includes an electron-emissive layer (418) being formed on the first opposed surface (202). Cathodes (420) are disposed on the electron-emissive layer (418) and cross the extraction electrodes (410) at an angle of 90°. A method for fabricating said field emission device (400) includes stamping a layer (100) of the softened calendered tape with a die (300) to define the apertures (206) and grooves (208, 212, 214).

10 Claims, 3 Drawing Sheets

400

FIELD EMISSION DEVICE HAVING STAMPED SUBSTRATE AND METHOD

REFERENCE TO RELATED APPLICATIONS

Related subject matter is disclosed in the following, commonly assigned patent applications: (1) "Edge Electron Emitters for an Array of FEDs", U.S. patent application Ser. No. 08/489,017, filed Jun. 08, 1995, now U.S. Pat. No. 5,691,600 and (2) "Method for Fabricating an Array of Edge Electron Emitters", attorney docket number CR96-121, filed Dec. 20, 1996.

FIELD OF THE INVENTION

The present invention pertains to the area of field emission devices and, more particularly, to edge electron emitters.

BACKGROUND OF THE INVENTION

Field emission devices, including edge electron emitters, are known in the art. Unlike Spindt-tip field emitters, edge emitters are simpler to make and eliminate problems such as electrical shorts between emitter tip and grid, too much grid current, deteriorating tips, and exploding tips.

Prior art substrates for Spindt-tip field emitters and existing edge emitters are formed from glass or silicon. A glass substrate for an array of edge emitters is configured by employing a sawing process. The sawing process limits the dimensions of the features of the substrate. It may also introduce non-uniformities due to wear on the saw blade.

Accordingly, there exists a need for an improved method for fabricating a substrate for an array of edge electron emitters which is simple to perform, allows the formation of features having smaller dimensions than those permitted by sawing technology, and results in uniform dimensions over the array.

Figure 1:
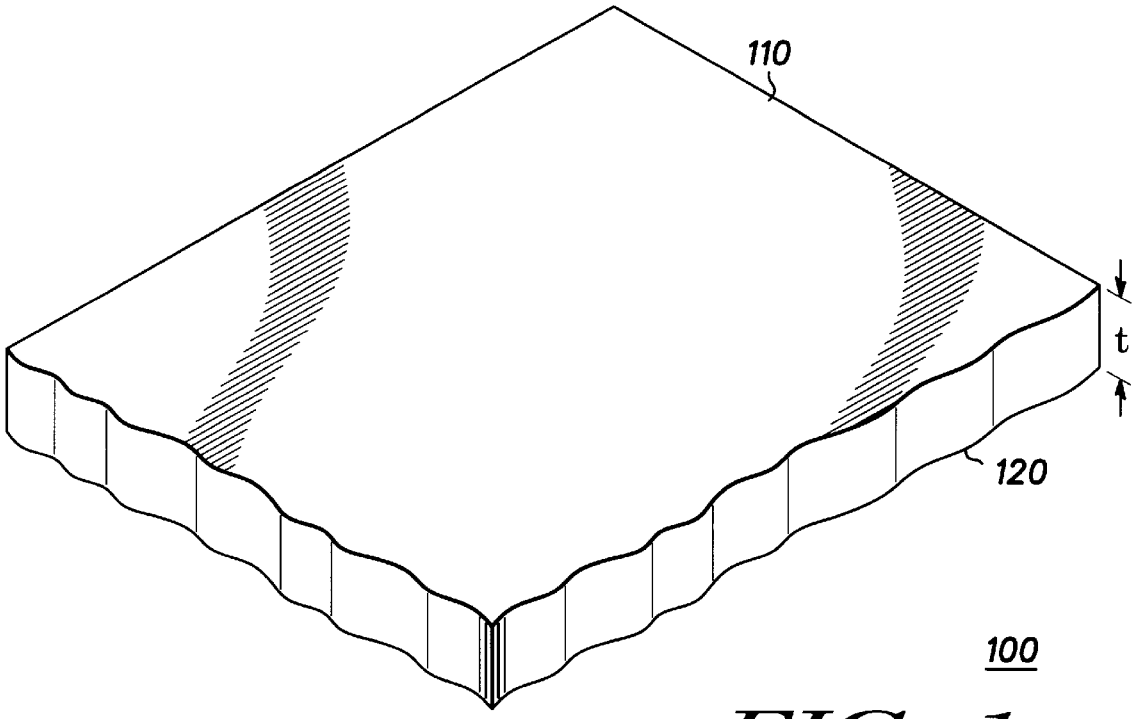
FIG. 1 is a perspective view of a layer of calendered tape used in a method for forming a field emission device in accordance with the present invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

A field emission device having a stamped substrate and a method for fabricating a field emission device having a stamped substrate, in accordance with the present invention, provides many improvements over the prior art. The field emission device of the present invention improves the resolution of the electron emission by providing a more dense array of addressable electron emitters. Another important improvement derived from the present invention includes improved uniformity of the dimensions of device features.

Referring now to FIG. 1 there is depicted a perspective view of a layer 100 of a plastically deformable ceramic used in a method for fabricating a field emission device, in accordance with the present invention. Layer 100 is used to form a stamped substrate for use in a field emission device having an array of edge electron emitters, which is described in greater detail with reference to FIGS. 2–5.

In the preferred embodiment, layer 100 comprises a calendered tape. In general, a calendered tape includes a mixture of a ceramic and a binder. In the preferred embodiment, the calendered tape comprising layer 100 is made from a mixture including: 20% by weight polyvinylbutyrol, 25% by weight butyl benzyl phthalate, and 55% by weight a mixture of $Al_2O_3$ and $ZrO_2$. The mixture of $Al_2O_3$ and $ZrO_2$ has a molar percentage of $ZrO_2$ within a range of 0–100%.

Predetermined thermal expansion and contraction characteristics are imparted to the stamped substrate by adjusting the molar percentage of $ZrO_2$ in the mixture of $Al_2O_3$ and $ZrO_2$. For example, for a field emission device having other packaging elements made from sodalime glass, the molar percentage of $ZrO_2$ is about 80% and the molar percentage of $Al_2O_3$ is about 20%. This composition provides a substrate having thermal expansion and contraction characteristics similar to those of the sodalime glass.

Layer 100 includes a plastically deformable ceramic in its green state. This green state is achieved by forming a hot-melt of the mixture of the ceramic and the binder and heating the mixture to a temperature such that it may be pressed into a layer. For the preferred embodiment, the mixture is heated to a temperature within a range of 100–120° C. to melt the thermoplastic binder system and allow it to be molded. The heated mixture is pressed into a layer by, for example, pressing it between rollers. Layer 100 includes first and second opposed surfaces 110, 120 and has a thickness of about 0.7 millimeters.

Figure 2:
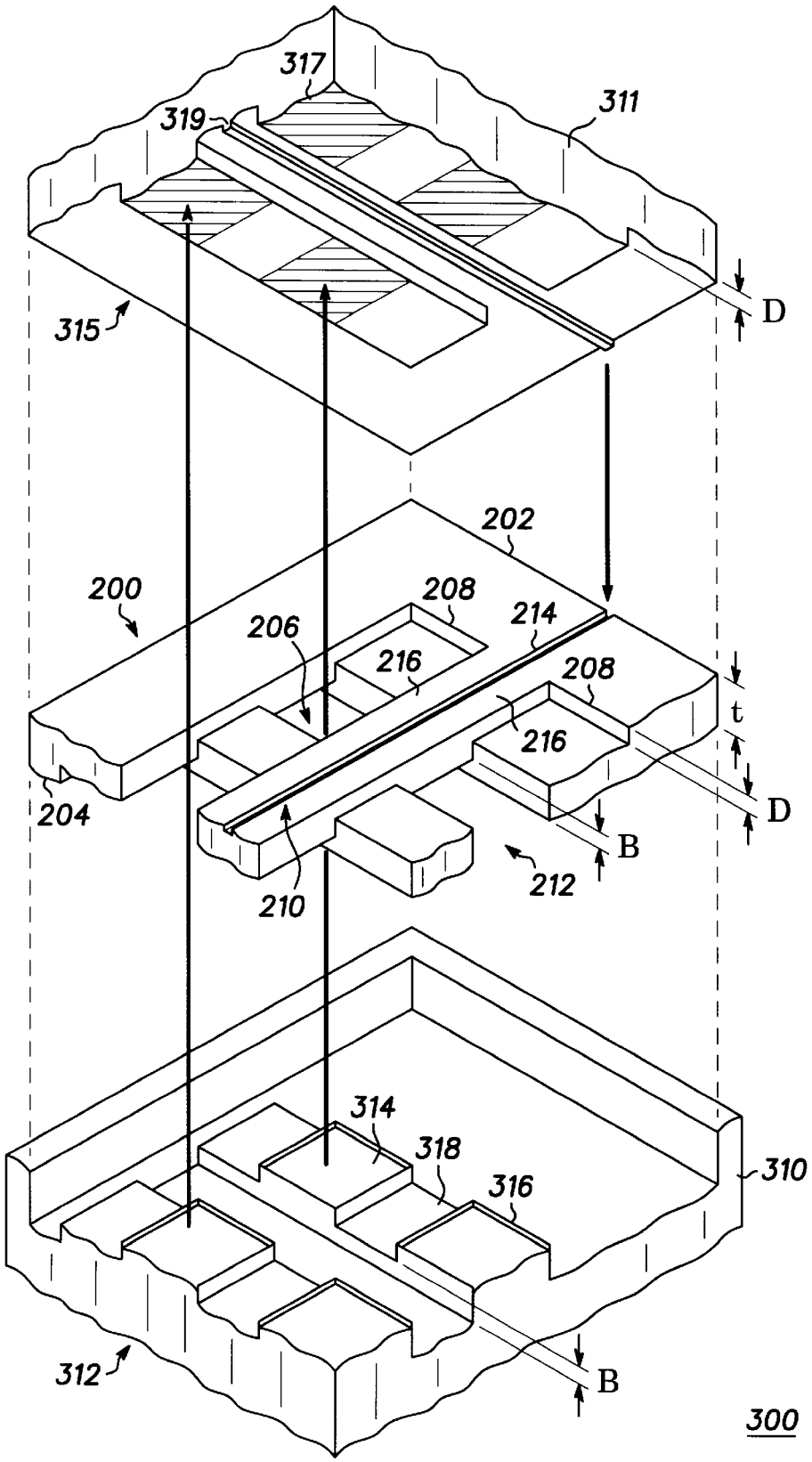
FIG. 2 is an exploded perspective view of a stamped substrate and a metal die useful in fabricating a field emission device in accordance with the present invention.

Referring now to FIG. 2 there is depicted a perspective view of an embodiment of a stamped substrate 200 made from layer 100 shown in FIG. 1. FIG. 2 further includes a perspective view of a die 300 used to stamp layer 100 to fabricate stamped substrate 200. Stamped substrate 200 has first and second opposed surfaces 202, 204 and includes a plurality of apertures 206.

A plurality of first grooves 208 is formed in first opposed surface 202, thereby defining a plurality of lands 210 in first opposed surface 202. A plurality of second grooves 212 is formed in second opposed surface 204. In the embodiment of FIG. 2, first grooves 208 are formed to a first depth D, and second grooves 212 are formed to a second depth B. The sum of first and second depths D and B is less than the thickness t of stamped substrate 200. Each of second grooves 212 crosses first grooves 208 at an angle, preferably 90°, to define a plurality of intersecting regions. One of apertures 206 is formed at each of the intersecting regions.

The embodiment of FIG. 2 further includes a groove 214 being formed in first opposed surface 202 at each of lands 210. Groove 214 extends the length of lands 210 to define a plurality of sub-lands 216.

Die 300 includes first and second stamping plates 310, 311, which are made from a convenient hard material, such as stainless steel, die steel, and the like. First stamping plate 310 includes a relief 312 which forms second grooves 212 and apertures 206. In the particular example of FIG. 2, relief 312 includes first raised portions 314, which include sharp edges 316. When die 300 is pressed into layer 100 shown in FIG. 1, in the manner indicated by arrows in FIG. 2, sharp edges 316 cut out material from layer 100 to form apertures 206. In this manner one of apertures 206 is formed through layer 100 at each point or area where one of first grooves 208 intersects one of second grooves 212. Thus, stamped substrate 200 defines a two dimensional array of apertures 206 positioned in rows and columns.

The step of forming apertures 206 may include pressing layer 100 at the intersecting regions of first and second grooves 208, 212. The material therein is thereby pressed into a thin web. This thin web is removed to form apertures 206. The removal may be accomplished by physical or chemical methods, such as sand blasting, etching with an kerosene etchant, and the like.

Relief 312 further includes second raised portions 318 which press into second opposed surface 120 of layer 100 shown in FIG. 1 to form the remaining portions of second grooves 212. Second stamping plate 311 has a relief 315, which includes first raised portions 317. First raised portions 317 press into first opposed surface 110 of layer 100 to form first grooves 208. Relief 315 further includes second raised portions 319, which are pressed into first opposed surface 110 of layer 100 to form grooves 214.

Other die configurations can be used. For example, a puncturing element may be substituted for sharp edges 316.

To fabricate the embodiment of FIG. 2, layer 100 is heated to a temperature within a range of 100–120° C. during the step of stamping layer 100 with die 300. Thereafter, die 300 is removed, and the stamped layer is hardened by a sintering process. The sintering process includes heating to a temperature greater than or equal to about 1300° C. in an oven for about an hour. Then, the sintered calendered tape is cooled. Thereafter, first and second opposed surfaces 202, 204 are preferably planarized, as by mechanical polishing, such as polishing with a diamond paste.

The use of calendered tape provides the important advantage of reproducibility of shrinkage upon firing. Shrinkage is reproducible to within about 0.1%. This excellent control of shrinkage is an important consideration in the manufacture of field emission devices.

In the embodiment of FIG. 2, and in no way intended to be limiting, the width of each of first and second grooves 208, 212 is about 500 micrometers, and the width of each of lands 210 is also about 500 micrometers. The width of groove 214 is about 150 micrometers, and its depth is about 200 micrometers. To realize such micron-sized features, die 300 is fabricated using well known machining methods from a metal, such as stainless steel, die steel, and the like. One such method includes electrical discharge machining which can be used to realize features having dimensions greater than or equal to about 150 microns.

Figure 3:
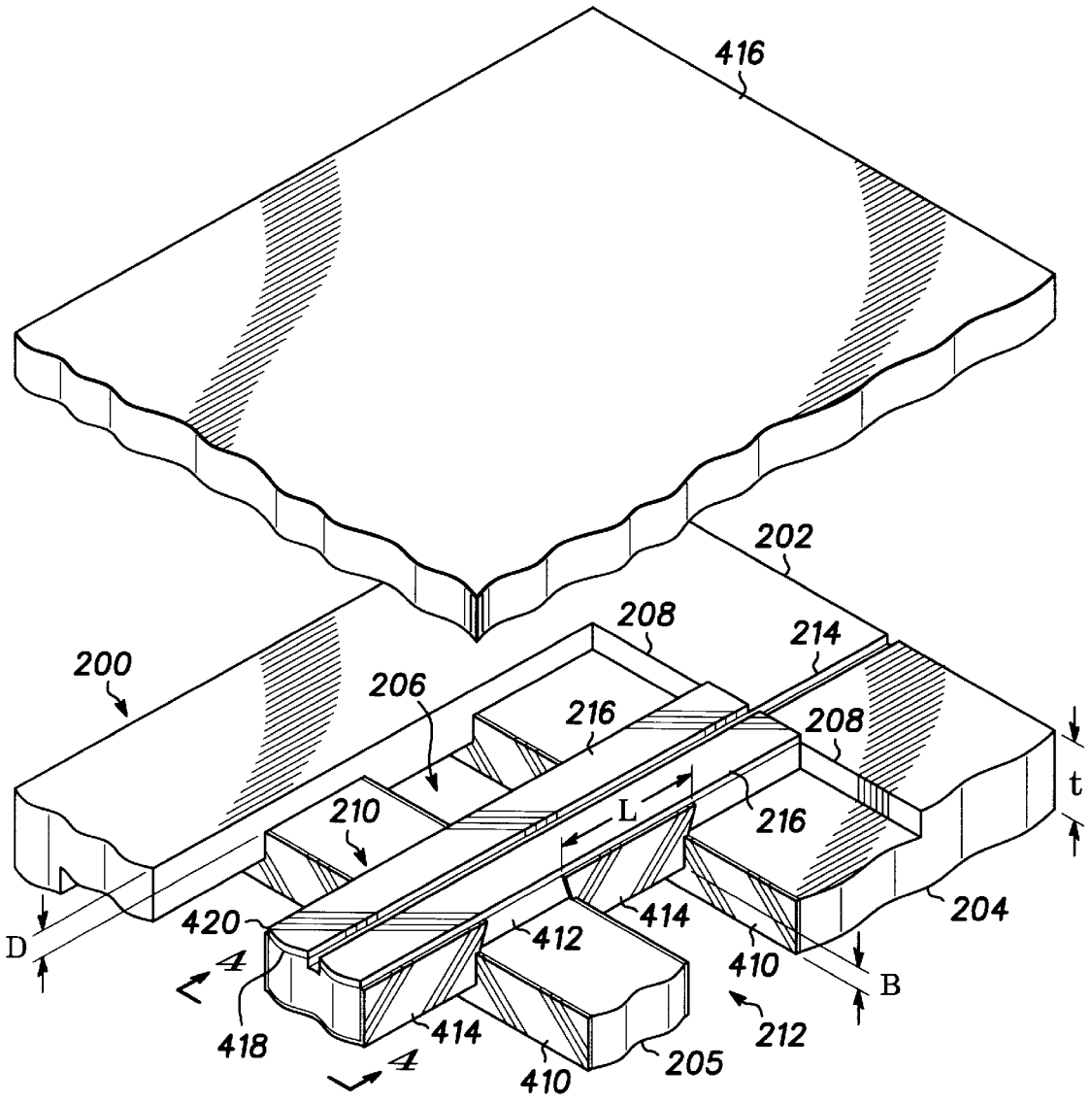
FIG. 3 is a perspective view of a field emission device constructed in accordance with the present invention.

Referring now to FIG. 3, there is depicted a perspective view of a field emission device 400 including stamped substrate 200. After stamped substrate 200 is formed according to the steps described with reference to FIGS. 1 and 2, the device electrodes and the electron-emissive layer are formed on stamped substrate 200.

First, a plurality of extraction electrodes 410 are formed on stamped substrate 200. Each of extraction electrodes 410 includes a continuous conductive layer which extends the length of one of second grooves 212. The continuous conductive layer is formed on the walls that define second groove 212 and on the surfaces defining the ones of apertures 206 which are disposed along second groove 212.

Extraction electrodes 410 are formed by first directing a gaseous source (not shown) of the conductive material, such as gaseous aluminum, toward second opposed surface 204. In this manner, second opposed surface 204 forms a shadow mask for the deposition. The conductive material is thereby deposited on second opposed surface 204, on the surfaces which define second grooves 212, and on the surfaces which define apertures 206. Also, a plurality of gaps 412 occur in the conductive layer on the opposing surfaces defining first grooves 208, between adjacent ones of apertures 206. Those portions of the conductive layer which define gaps 412 include a plurality of gates 414. This deposition can be performed by any well known method, such as electron beam evaporation.

Thereafter, the conductive material is removed from those portions 205 of second opposed surface 204 which do not define second grooves 212. In this manner extraction electrodes 410 are electrically isolated from one another. This material is removed by a convenient method, such as polishing. A similar method is used to remove conductive material from first opposed surface 202.

As further illustrated in FIG. 3, field emission device 400 includes an anode 416 which is spaced from first opposed surface 202 of stamped substrate 200. Field emission device 400 further includes an electron-emissive layer 418, which is formed on lands 210. Also, a cathode 420 is formed on electron-emissive layer 418 at each of sub-lands 216. These elements are described in greater detail with reference to FIG. 4.

Figure 4:
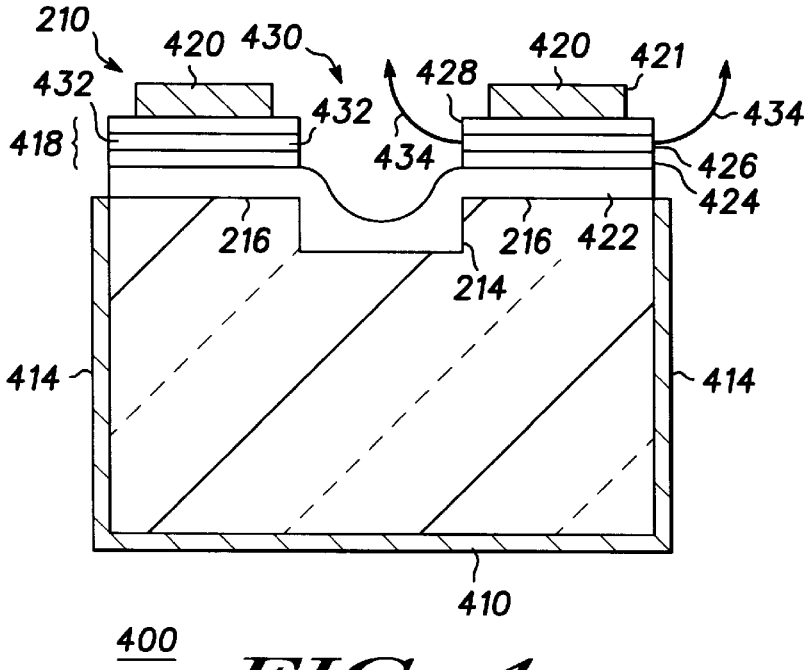
FIG. 4 is a cross-sectional view taken along section line 4—4 of FIG. 3.

Referring now to FIG. 4, there is depicted a cross-sectional view taken along section line 4—4 of FIG. 3. Subsequent to the formation of extraction electrodes 410, a plurality of blanket layers are formed on lands 210. These layers include a dielectric layer 422 and electron-emissive layer 418. In the embodiment of FIG. 4, electron-emissive layer 418 further comprises a first resistive layer 424, an emissive layer 426, and a second resistive layer 428.

Dielectric layer 422 includes a dielectric material, such as silicon dioxide, silicon nitride, and the like. The dielectric material is deposited upon lands 210 by some convenient method, such as plasma enhanced chemical vapor deposition (PECVD), evaporating, sputtering, and the like. Dielectric layer 422 has a thickness of about 0.5 $\mu$m. Dielectric layer 422 is utilized to insulate, and vertically space, electron-emissive layer 418 from gate 414.

In the embodiment of FIG. 4, first resistive layer 424 is made from amorphous silicon and has a thickness of about 1000 angstroms. Emissive layer 426 is formed on first resistive layer 424 and is made from a field emissive material, having a low work function. Emissive layer 426 is preferentially comprised of one of, for example, diamond, diamond-like carbon, non-crystalline diamond-like carbon, partially graphitized nanocrystalline carbon, aluminum nitride, and any other electron emissive material exhibiting surface work function of less than approximately 1.0 electron volts. In the embodiment of FIG. 4, emissive layer 426 has a thickness of about 1500 angstroms. Second resistive layer 428 is formed on emissive layer 426. Second resistive layer 428 is made from amorphous silicon and has a thickness of about 1000 angstroms.

Methods for forming field emissive films, including diamond-like carbon films, are known in the art. For example, an amorphous hydrogenated carbon film can be deposited by plasma-enhanced chemical vapor deposition using gas sources such as cyclohexane, n-hexane, and methane. One such method is described by Wang et al. in "Lithography Using Electron Beam Induced Etching of a Carbon Film", *J. Vac. Sci. Technol*, Sept/Oct 1995, pp. 1984–1987. The deposition of diamond films is described in U.S. Pat. No. 5,420,443 entitled "Microelectronic Structure Having an Array of Diamond Structures on a Nondiamond Substrate and Associated Fabrication Methods" by Dreifus et al., issued May 30, 1995. The deposition of a diamond-like carbon film is further described in "Lithographic Application of Diamond-like Carbon Films" by Seth et al., *Thin Solid* Films, 1995, pp. 92–95. Other field emissive materials are described in the following patent applications, having the same assignee: "Electronemissive Film and Method" by Coll et al., U.S. patent application Ser. No. 08/720,512, filed Sep. 30, 1996; and "Amorphous Multi-Layered Structure and Method of Making the Same" by Menu et al., U.S. patent application Ser. No. 08/614,703, filed Mar. 13, 1996 now U.S. Pat. No. 5,837,331.

The electron-emissive layer may include only the emissive layer. Alternatively, the electron-emissive layer may include any one of the multi-layer emitter assemblies disclosed in "Ballistic Charge Transport Device with Integral Active Contaminant Absorption Means", U.S. Pat. No. 5,502,348, filed on Dec. 17, 1993.

Referring once again to FIG. 4, subsequent the blanket depositions of layers 422, 424, 426, 428, cathodes 420 are formed on second resistive layer 428. Cathodes 420 are made from a conductive material, such as aluminum or molybdenum. In the embodiment of FIG. 4, cathodes 420 are formed by a roll-coating method. During the depositions of layers 422, 424, 426, 428, groove 214 causes a depression 430 to be formed. The roll-coating step deposits the conductive material comprising cathodes 420 on either side of depression 430. In this manner, two cathodes 420 are formed on each of lands 210.

Thereafter, layers 422, 424, 426, 428 are selectively etched to form edges, including a plurality of electron emissive edges 432 defined by emissive layer 426. These edges are configured flush with gate 414. The selective etching includes forming a photoresist on cathodes 420 and on second resistive layer 428 between cathodes 420. Alternatively, the selective etching of layers 422, 424, 426, 428 may be performed prior to the formation of cathodes 420.

Second resistive layer 428, emissive layer 426, and first resistive layer 424 are etched using chemical etchants. For the embodiment of FIG. 4, an etchant for the amorphous silicon comprising layers 428, 424 includes trifluoromethane and $SF_6$ in helium; and an etchant for a carbon-based material comprising emissive layer 426 includes oxygen in helium. The silicon dioxide comprising dielectric layer 422 may be etched with $C_2F_6$ in helium. A patterning step may be included to laterally retract an edge 421 of cathode 420 from electron emissive edge 432, as illustrated in FIG. 4.

In the embodiment of FIG. 4, self-aligned masking is used to selectively etch layers 424, 426, 428 at depression 430, such that emissive edges 432 are also realized within depression 430. In this manner cathodes 420 on sub-lands 216 are electrically isolated from one another. The self-aligned masking may be performed by roll-coating the masking material onto sub-lands 216, so that the masking material is not deposited within depressions 430. Thereafter, layers 424, 426, 428 are selectively etched. Then, the masking material, which may include a polymer or photoresist, is removed.

In yet another embodiment, groove 214 is omitted, and one cathode is formed on second resistive layer 428 at each of lands 210, such that both electron emissive edges 432 on either side of land 210 are simultaneously addressed. In yet another embodiment the edges of layers 424, 426, 428 are laterally displaced from gate 414. This may be done so that electron emissive edges 432 are disposed at those regions in space wherein conditions for electron emission are more favorable. Convenient patterning methods will occur to one skilled in the art.

In the embodiment of FIG. 4, first and second resistive layers 424, 428 are included to provide ballasting. The reason for providing the setback in edges 421 of cathodes 420 from electron emissive edges 432 is to provide a proper lateral ballast resistance therebetween. The portions of resistive layers 424 and/or 428 between cathode 420 and electron emissive edge 432 act as a lateral ballast resistor. The primary determinants of the amount of resistance supplied by the ballast resistor are the materials comprising layers 424, 426, 428 and the distance between cathode 420 and electron emissive edge 432. The incorporation of ballasting resistors in the array of edge electron emitters provides uniform current distribution throughout the array. In another embodiment of the present invention the emissive layer is made from an electron emissive material which provides a lateral resistance that obviates the need for the first and/or second resistive layers.

In the embodiment of FIG. 4 for each of lands 210, one of cathodes 420 is used to address electron emissive edges 432 which are disposed along one of sub-lands 216; the other of cathodes 420 is used to address electron emissive edges 432 which are disposed along the other of sub-lands 216. In contrast to the configuration wherein one cathode is formed on each of lands 210, the configuration depicted in FIG. 4 results in smaller electron beams and smaller spot sizes at anode 416, thereby improving the resolution at anode 416.

Another feature of the invention which results in improved resolution of the device is the reduced length of each of electron emissive edges 432. The length of each of electron emissive edges 432 is determined by the length, L, of gate 414. When an extraction potential is applied to gate 414, a portion of the edge of emissive layer 426 is caused to emit electrons. This portion of the edge of emissive layer 426 comprises one of electron emissive edges 432. By reducing the length, L, of gate 414, the length of each of electron emissive edges 432 is reduced. This results in smaller electron beams and smaller spot sizes at anode 416, thereby providing improved resolution of the device.

The length, L, of gate 414 is reduced, in part, due to the ability to form shallow first grooves 208 using the stamping method. The first depth, D, of first grooves 208 (FIG. 3) is controlled by the features of die 300 and the pressure applied to die 300 during the stamping procedure. This allows fine control over first depth, D, of first grooves 208. Also, the formation of apertures 206 is independent of the formation of first and second grooves 208, 212. Apertures 206 are formed by a cutting out, puncturing, or etching method and are, therefore, independent of the depths of first and second grooves 208, 212.

A reduction in first depth, D, of first grooves 208 results in less spread or fanning of the conductive material on the surfaces defining first grooves 208 during the formation of extraction electrodes 410. This reduced spread or fanning results in each of gates 414 having a shorter length, L, thereby defining shorter electron emissive edges 432 and improved resolution.

Furthermore, the width of each of second grooves 212 is not constrained, as it is in the prior art, to the width of a saw blade. Instead, the width of each of second grooves 212 can be made smaller via the stamping method of the invention. Die 300 (FIG. 2) is formed by machining a piece of stainless steel so that first and second raised portions 314, 318 have the predetermined width of second grooves 212. In this manner widths on the order of 150 micrometers are achievable. By reducing the width of second grooves 212, the length, L, of gates 414 may be further reduced, and the resolution of the device further improved.

The operation of field emission device 400 includes operably coupling a voltage source (not shown) to each of extraction electrodes 410, cathodes 420, and anode 416. An example of a convenient potential configuration for providing electron emission includes applying a potential of about 80 volts to one of extraction electrodes 410, holding one of cathodes 420 at electrical ground, and applying a potential of about 5000 volts to anode 416. Each of electron emissive edges 432 is selectively addressable by applying these potentials to the extraction electrode and the cathode which together define the position of the given electron emissive edge. Arrows 434 in FIG. 4 represents emitted electrons as they travel from ones of electron emissive edges 432 toward anode 416.

In summary, a field emission device has been disclosed which includes a stamped substrate made from a plastically deformable ceramic. The present invention provides many improvements over the prior art. The device is simple to fabricate and has uniform feature dimensions. A method according to the present invention allows the fabrication of complex features which are not realizable using prior art methods. Also, the time required for fabrication is made independent of substrate size. The present invention further provides reduced electron spot size and improved resolution.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. A field emission device comprising a plasticallydeformable, ceramic, stamped substrate, wherein the plastically-deformable, ceramic, stamped substrate comprises a calendered tape.

2. A field emission comprising a plastically-deformable, ceramic, stamped substrate, wherein the plastically-deformable, ceramic, stamped substrate comprises 20% by weight polyvinylbutyrol, 25% by weight butyl benzyl phthalate, and 55% by weight a mixture of $Al_2O_3$ and $ZrO_2$, the mixture of $Al_2O_3$ and $ZrO_2$having a molar percentage of $ZrO_2$ within a range of 0–100%.

3. A field emission device comprising:

a plastically-deformable, ceramic, stamped substrate having first and second opposed surfaces, and having walls defining a plurality of apertures;

an electron-emissive layer disposed on the first opposed surface of the plastically-deformable, ceramic, stamped substrate and defining an electron emissive edge proximate to each of the plurality of apertures;

a cathode disposed on the electron-emissive layer proximate to the electron emissive edges;

a plurality of extraction electrodes, each of the plurality of extraction electrodes comprising a continuous conductive layer being disposed on the walls defining one of the plurality of apertures to define a gate within each of the plurality of apertures, each of the plurality of extraction electrodes being electrically isolated from the other ones of the plurality of extraction electrodes, each gate being proximate to one of the electron emissive edges, the cathode overlying the plurality of extraction electrodes; and an anode opposing the first opposed surface of the plastically-deformable, ceramic, stamped substrate.

4. The field emission device of claim 3, wherein the plastically-deformable, ceramic, stamped substrate comprises a calendered tape.

5. The field emission device of claim 3, wherein the plastically-deformable, ceramic, stamped substrate comprises 20% by weight polyvinylbutyrol, 25% by weight butyl benzyl phthalate, and 55% by weight a mixture comprising $Al_2O_3$ and $ZrO_2$, the mixture having a molar percentage of $ZrO_2$ within a range of 0–100%.

6. A field emission device comprising:

a plastically-deformable, ceramic, stamped substrate, having first and second opposed surfaces, and having first walls defining a plurality of apertures;

a plurality of first grooves formed in the first opposed surface and defining a plurality of lands in the first opposed surface;

a plurality of second grooves formed in the second opposed surface, each of the plurality of second grooves crossing the plurality of first grooves at an angle to define a plurality of intersecting regions, the plurality of apertures being disposed one each at the plurality of intersecting regions, each of the plurality of second grooves being defined by second walls;

an electron-emissive layer disposed on the plurality of lands and defining an electron emissive edge proximate to each of the plurality of apertures;

a cathode disposed on the electron-emissive layer at each of the plurality of lands;

an extraction electrode being disposed in each of the plurality of second grooves on the second walls thereof and further being disposed on the first walls of the ones of the plurality of apertures partially defined thereby, such that a gate is defined proximate to each of the electron emissive edges; and an anode opposing the first opposed surface of the plastically-deformable, ceramic, stamped substrate.

7. The field emission device of claim 6, wherein the plastically-deformable, ceramic, stamped substrate has a predetermined thickness, wherein the plurality of first grooves is formed in the first opposed surface to a first depth and the plurality of second grooves is formed in the second opposed surface to a second depth, and wherein the sum of the first and second depths is less than the predetermined thickness of the plastically-deformable, ceramic, stamped substrate.

8. The field emission device of claim 6, further comprising a groove being formed in the first opposed surface at each of the plurality of lands and extending the length of the plurality of lands to define a plurality of sub-lands, wherein the cathodes are disposed one each on the plurality of sub-lands.

9. The field emission device of claim 6, wherein the plastically-deformable, ceramic, stamped substrate comprises a calendered tape.

10. The field emission device of claim 6, wherein the plastically-deformable, ceramic, stamped substrate comprises 20% by weight polyvinylbutyrol, 25% by weight butyl benzyl phthalate, and 55% by weight a mixture comprising $Al_2O_3$ and $ZrO_2$, the mixture having a molar percentage of $ZrO_2$ within a range of 0–100%.

* * * * *